US006461277B2

(12) United States Patent
Maresh et al.

(10) Patent No.: US 6,461,277 B2
(45) **Date of Patent: *Oct. 8, 2002**

(54) EXERCISE METHODS AND APPARATUS

(76) Inventors: Joseph D. Maresh, P.O. Box 645, West Linn, OR (US) 97068-0645; Kenneth W. Stearns, P.O. Box 55912, Houston, TX (US) 77255

( * ) Notice: Subject to any disclaimer, the term of this patent is extended or adjusted under 35 U.S.C. 154(b) by 0 days.

This patent is subject to a terminal disclaimer.

(21) Appl. No.: 09/748,394

(22) Filed: Dec. 26, 2000

(65) Prior Publication Data

US 2001/0016541 A1 Aug. 23, 2001

Related U.S. Application Data

(62) Division of application No. 09/065,308, filed on Apr. 23, 1998.

(60) Provisional application No. 60/044,961, filed on Apr. 26, 1997.

(51) Int. Cl.[7] ..... A63B 22/00; A63B 69/16

(52) U.S. Cl. ..... 482/52; 482/70; 482/51

(58) Field of Search ..... 482/51, 52, 53, 482/57, 70, 79, 80

(56) References Cited

U.S. PATENT DOCUMENTS 5,997,445 A * 12/1999 Maresh et al. ..... 482/70
6,248,044 B1 * 6/2001 Stearns et al. ..... 482/52

* cited by examiner

*Primary Examiner*—Stephen R. Crow

(57) ABSTRACT

An exercise apparatus includes left and right connector links having first portions rotatably connected to respective cranks, second portions constrained to move in reciprocating fashion, and third, lower end portions rotatably connected to respective foot supporting links. Rocker links are rotatably interconnected between the frame and discrete portions of respective foot supporting links, and rearward ends of the foot supporting links are configured to support a person's feet in cantilevered fashion. The resulting assembly links rotation of the cranks to movement of the cantilevered ends of the foot supports through generally elliptical paths.

12 Claims, 1 Drawing Sheet

EXERCISE METHODS AND APPARATUS

CROSS-REFERENCE TO RELATED APPLICATIONS

This application is a divisional of U.S. patent application Ser. No. 09/065,308, filed on Apr. 23, 1998, which in turn, discloses subject matter entitled to the filing date of U.S. Provisional Application Ser. No. 60/044,961, filed on Apr. 26, 1997.

FIELD OF THE INVENTION

The present invention relates to exercise methods and apparatus and more particularly, to exercise equipment that facilitates elliptical exercise motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to more closely approximate walking and/or running motions. Such equipment typically uses some sort of linkage assembly to convert a relatively simple motion, such as circular, into a relatively more complex motion, such as elliptical. Exercise equipment has also been designed to facilitate total body exercise. For example, reciprocating cables or pivoting arm poles have been used on many of the foregoing types of exercise equipment to facilitate contemporaneous upper body and lower body exercise. Despite many such advances in the art, room for improvement remains.

SUMMARY OF THE INVENTION

The present invention may be seen to provide a novel linkage assembly and corresponding exercise apparatus suitable for linking circular motion to relatively more complex, generally elliptical motion. On a preferred embodiment, for example, a linear connector link has a first portion rotatably connected to a crank; a second portion rotatably connected to a first rocker link; and a lower end rotatably connected to a foot support. A second rocker link is rotatably interconnected between the frame and a discrete portion of the foot support. As the crank rotates, the linkage assembly constrains a cantilevered, rearward portion of the foot support to travel through a generally elliptical path.

In another respect, the present invention may be seen to provide a novel linkage assembly and corresponding exercise apparatus suitable for linking reciprocal motion to relatively more complex, generally elliptical motion. For example, a handle may be pivotally mounted on the frame and linked to one of the linkage assembly components in such a manner that, as the cantilevered portion of the foot support moves through its generally elliptical path, the handle moves in reciprocal fashion relative to the frame.

In yet another respect, the present invention may be seen to provide a novel linkage assembly and corresponding exercise apparatus suitable for adjusting the elliptical path of motion. For example, at least one of the rocker links may be selectively adjustable relative to the frame to alter the configuration and/or orientation of the foot path. Additional features and/or advantages of the present invention may become more apparent from the more detailed description set forth below.

DETAILED DESCRIPTION OF THE PREFERRED EMBODIMENT

Figure 1:
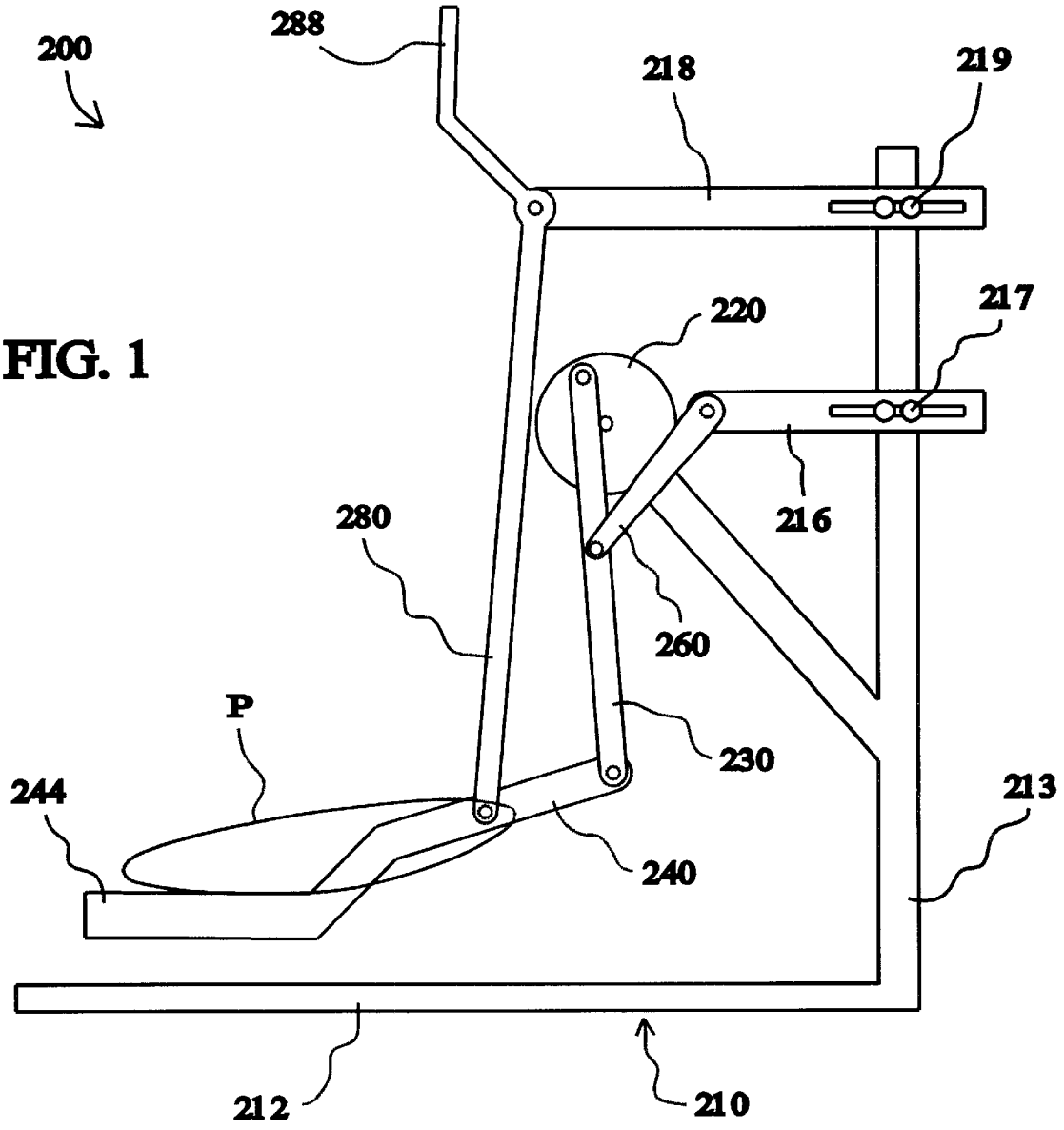
FIG. 1 is a side view of a preferred embodiment exercise apparatus constructed according to the principles of the present invention.

A preferred embodiment exercise apparatus constructed according to the principles of the present invention is designated as 200 in FIG. 1. The exercise apparatus 200 generally includes a frame 210 and left and right linkage assemblies movably mounted on the frame 210. The linkage assemblies move relative to the frame 210 in a manner that links rotation of respective cranks 220 to generally elliptical motion of respective foot supports 244. The term "elliptical motion" is intended in a broad sense to describe a closed path of motion P having a relatively longer first axis and a relatively shorter second axis (which is perpendicular to the first axis).

The exercise apparatus 200 is generally symmetrical about a plane that extends longitudinally through the center of the frame 210, the primary exception being that the left and right linkage assemblies are preferably constrained to remain 180° out of phase with one another. For ease of illustration, only the near side or "right-hand" linkage assembly is shown in FIG. 1, and when reference is made to one or more parts on one side of the apparatus 200, it is to be understood that corresponding part(s) are disposed on the opposite side, as well. Those skilled in the art will also recognize that the portions of the frame 210 which are intersected by the plane of symmetry exist individually and thus, do not have "opposite side" counterparts.

The frame 210 includes a base 212 which extends from a forward end to a rearward end, and which is configured to rest upon a floor surface. For example, the base 212 may be U-shaped or I-shaped. A forward stanchion or upright support 213 extends upward from the base 212 proximate its forward end. A first support arm 216 is mounted on an intermediate portion of the stanchion 213 by means of fasteners 217, and a second support arm 218 is mounted on an upper distal portion of the stanchion by means of similar fasteners 219.

Each linkage assembly includes a crank 220 rotatably mounted on the frame 210, a first rocker link 260 pivotally mounted on the first support arm 216, and a second rocker link 280 pivotally mounted on the second support arm 218. A linear connector link 230 has an upper end rotatably connected to the crank 220; an intermediate portion rotatably connected to the first rocker link 260; and a lower end rotatably connected to a forward end of a foot supporting link 240.

An upper distal end 288 of the second rocker link 280 is sized and configured for grasping, and a lower distal end of the second rocker link 280 is rotatably connected to an intermediate portion of the foot supporting member 240. An opposite, rearward end 244 of the foot supporting link 240 is sized and configured to support a foot of a standing person.

The foot supporting link 240 extends generally parallel to an underlying floor surface, and the connector link 230 and the second rocker link 250 extend generally perpendicular to the underlying floor surface throughout an entire exercise cycle. The resulting linkage assembly links rotation of the crank 220 to generally elliptical movement of the foot support 244 through the path designated as P. The pivot axes of the rocker links 260 and/or 280 may be adjusted relative to the frame 210 to change the path of exercise motion. On the embodiment 200, for example, the support arms or brackets 216 and 218 are slotted to accommodate horizontal movement relative to the stanchion 213, and the fasteners 217 and 219 releasably lock the respective brackets 216 and 218 in place.

To use the apparatus 200, a person stands with a respective foot on each of the foot supports 244 and begins moving his or her feet in striding fashion. The linkage assemblies constrain the person's feet to move through elliptical paths P while the cranks 220 rotate relative to the frame 210. The handles 288 move in reciprocal fashion during rotation of the cranks 220, so that the person may exercise his or her arms simply by grasping a respective handle 288 in each hand. In the alternative, the person may simply balance during leg exercise and/or steady himself or herself relative to a stationary support (not shown) on the frame 210.

Those skilled in the art will recognize that the apparatus 200 may be modified in a number of ways without departing from the scope of the present invention. For example, the cranks 220 could be replaced by crank arms and a "stepped-up" flywheel, and/or supplemented with a drag strap or other known resistance device to provide momentum and/or resistance to exercise movement.

Although this disclosure is made with reference to a preferred embodiment and a particular application, persons skilled in the art are likely to recognize additional embodiments, modifications, and/or applications which nonetheless fall within the scope of the present invention. Thus, the scope of the present invention is to be limited only to the extent of the claims which follow.

What is claimed is:

1. An elliptical motion exercise apparatus, comprising:

a frame designed to rest upon a floor surface;

left and right cranks rotatably mounted on a forward portion of the frame, thereby defining a crank axis;

left and right first rocker links pivotally mounted on a forward portion of the frame, thereby defining a first pivot axis;

left and right second rocker links pivotally mounted on a forward portion of the frame, thereby defining a second pivot axis;

left and right foot supporting links having first connection points rotatably connected to respective second rocker links, and rearward distal ends configured to support a person's feet in cantilevered fashion; and left and right connector links having respective first connections points rotatably connected to respective cranks, and respective second connection points rotatably connected to respective first rocker links, and lower distal ends rotatably connected to second connection points on respective foot supporting links, wherein said foot supporting links are constrained to remain generally horizontal throughout an exercise cycle, and said connector links are constrained to remain generally vertical throughout an exercise cycle.

2. The exercise apparatus of claim 1, wherein said first pivot axis is selectively adjustable relative to said frame.

3. The exercise apparatus of claim 2, wherein said second pivot axis is selectively adjustable relative to said frame.

4. The exercise apparatus of claim 1, wherein said second pivot axis is selectively adjustable relative to said frame.

5. The exercise apparatus of claim 1, further comprising a means for adjusting a distance defined between said first pivot axis and said crank axis.

6. The exercise apparatus of claim 1, further comprising a means for adjusting a distance defined between said second pivot axis and said crank axis.

7. The exercise apparatus of claim 1, further comprising a means for adjusting a distance defined between said first pivot axis and said second pivot axis.

8. The exercise apparatus of claim 1, further comprising left and right handles connected to respective second rocker links.

9. The exercise apparatus of claim 1, wherein said cranks and said links define respective linkage assemblies, and further comprising left and right handles pivotally connected to said frame and linked to respective linkage assemblies.

10. The exercise apparatus of claim 1, wherein said second connection points on said connector links are disposed directly between respective lower distal ends and respective first connection points on said connector links.

11. The exercise apparatus of claim 10, wherein said first connection points on said foot supporting links are disposed directly between respective rearward distal ends and respective second connection points on said foot supporting links.

12. The exercise apparatus of claim 1, wherein said first connection points on said foot supporting links are disposed directly between respective rearward distal ends and respective second connection points on said foot supporting links.

* * * * *